United States Patent [19]

Kawano et al.

[11] Patent Number: 4,817,804

[45] Date of Patent: Apr. 4, 1989

[54] COUNTING AND HALF-WRAPPING APPARATUS FOR BANKNOTES WITH THE FUNCTION OF DISCRIMINATING THE BANKNOTES OF DIFFERENT NOMINAL VALUES

[75] Inventors: Hikaru Kawano, Odawara; Koji Sato, Hiratsuka, both of Japan

[73] Assignees: Musashi Engineering Kabushiki Kaisha, Tokyo; Hitachi Denshi Engineering Kabushiki Kaisha, Kanagawa, both of Japan

[21] Appl. No.: 868,877

[22] Filed: May 23, 1986

Related U.S. Application Data

[63] Continuation of Ser. No. 601,802, Apr. 19, 1984, abandoned, which is a continuation-in-part of Ser. No. 561,562, Dec. 14, 1983, Pat. No. 4,511,301, and Ser. No. 601,795, Apr. 19, 1984, Pat. No. 4,566,244.

[30] Foreign Application Priority Data

Dec. 22, 1982 [JP] Japan ..... 57-223924
Apr. 30, 1983 [JP] Japan ..... 58-76487

[51] Int. Cl.[4] ..... B07C 5/34; B65B 35/50

[52] U.S. Cl. ..... 209/534; 53/54; 53/588; 209/551; 209/657; 377/8

[58] Field of Search ..... 209/534, 551, 656, 657; 53/54, 501, 588; 414/43; 377/8

[56] References Cited

U.S. PATENT DOCUMENTS 2,969,875 1/1961 McLeod et al. ..... 209/571
3,759,382 9/1973 Walkley et al. ..... 209/551 X
4,334,619 6/1982 Horino et al. ..... 209/551
4,406,449 9/1983 Buck ..... 414/43 X
4,424,660 1/1984 Sato et al. ..... 53/588 X
4,511,301 4/1985 Kawano et al. ..... 414/43
4,566,244 1/1986 Kawano et al. ..... 53/588

FOREIGN PATENT DOCUMENTS 54-111893 9/1979 Japan ..... 209/534

OTHER PUBLICATIONS

*Toshiba Currency Note Arranger,* Takehana et al., Toshiba Review, No. 130, Nov.-Dec. 1980, pp. 21-24.

*Primary Examiner*—Johnny D. Cherry
*Assistant Examiner*—Edward M. Wacyra
*Attorney, Agent, or Firm*—Brooks Haidt Haffner & Delahunty

[57] ABSTRACT

An apparatus adapted for counting the number of and half-wrapping banknotes and adapted to be capable of discriminating the banknotes of different nominal values, is disclosed. The apparatus is so constructed that a sensing or discriminating unit is provided in the transport route for the banknotes extracted by the separating drum for sensing or dicriminating the nominal values, authenticity and transport state of the notes, the banknotes after passing through the sensing and discriminating unit are transported by a changeover shutter plate in occasionally selected one of two preset directions, in such a manner that reject notes are accommodated in the reject note stacker and only the desired notes are accommodated in the stack unit for subsequent half-wrapping.

4 Claims, 3 Drawing Sheets

COUNTING AND HALF-WRAPPING APPARATUS FOR BANKNOTES WITH THE FUNCTION OF DISCRIMINATING THE BANKNOTES OF DIFFERENT NOMINAL VALUES

This application is a continuation of application Ser. No. 601,802, filed Apr. 19, 1984, now abandoned, which is a continuation-in-part of application Ser. No. 561,562 filed Dec. 4, 1983, now U.S. Pat. No. 4,511,301, and of Ser. No. 601,795, filed Apr. 19, 1984, now U.S. Pat. No. 4,566,244.

BACKGROUND OF THE INVENTION

This invention relates to an apparatus for counting the number of and half-wrapping or band-sealing paper sheets, such as banknotes.

Heretofore, this type of counting apparatus is not capable of discriminating the banknotes of different nominal values, hence the risk that the banknote or banknotes of different nominal value exist inadvertently in the half-wrapped bundle of banknotes of the desired nominal value, resulting in the sum correspondingly different from the correct value.

For obviating such deficiency, the banknotes are sorted according to their different nominal values prior to being introduced into the counting apparatus. However, since the sorting is carried out by manual operation, there is the risk that the banknotes other than those of the desired nominal value be inadvertently introduced into the sorted notes, resulting in the sum correspondingly different from the correct value. Moreover, the banknotes with folded edges or corners are difficult to set aside by the manual sorting operation. Hence, when the banknotes are introduced into the counting apparatus, those with folded edges or corners are counted and half-wrapped simultaneously with those positioned normally, thus resulting in half-wrapped bundles of the banknotes being out of alignment with one another.

SUMMARY OF THE INVENTION

It is a principal object of the present invention to provide such apparatus which avoids the aforementioned deficiency. According to the present invention, a unit for sensing or discriminating the nominal values, authenticity or transport state of the papernotes is provided in the transport route of the banknotes extracted by the feed-out drum. The banknotes after passing through the discriminating unit are changed in their transport directions by the changeover shutter plate in such a manner that reject notes are accommodated in the reject note stacker and only the desired notes are accommodated in the stack unit for half-wrapping.

By the term "desired banknotes" is meant herein those having the correct appearance and the nominal value corresponding to that being processed by the paper number counting and half-wrapping apparatus.

BRIEF DESCRIPTION OF THE DRAWINGS

The objects and advantages of the present invention will become more apparent from reading the following detailed description in connection with the accompanying drawings, in which.

DESCRIPTION OF THE PREFERRED EMBODIMENTS

Figure 1:
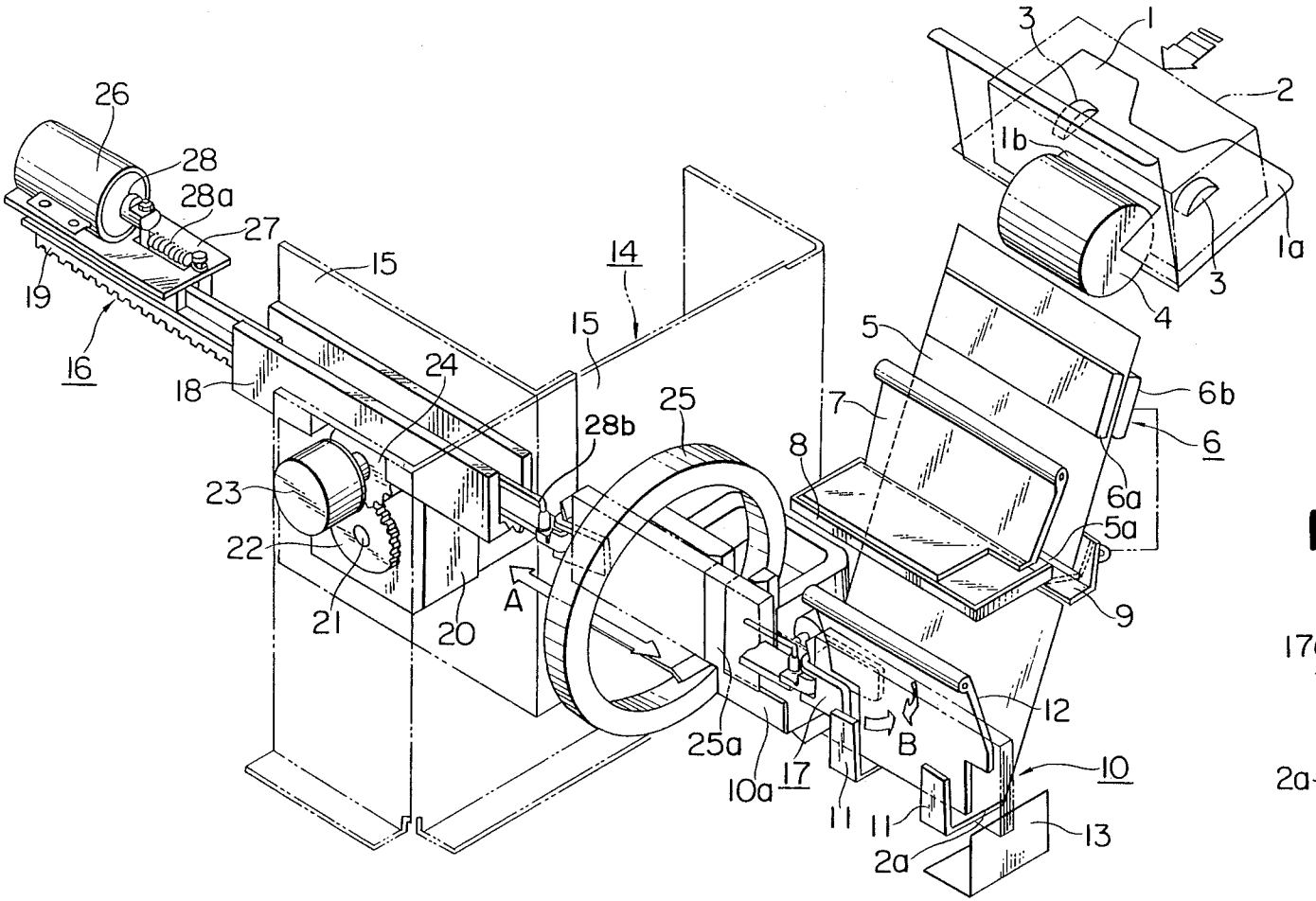
FIG. 1 is a schematic perspective view showing the overall construction of the paper number counting and half-wrapping apparatus adapted to be capable of discriminating the banknotes of different nominal values.

An apparatus for counting the number of and half-wrapping a batch of banknotes adapted to be capable of discriminating the banknotes of different nominal values according to the present invention is hereinafter described by referring to the accompanying drawings.

In the drawings, the numeral 1 designates an L-shaped stack plate on which is placed a pile of a large number of banknotes 2. A pair of guide rolls 3 project partially through slits formed in a bottom portion 1*a* of the stack plate 1 to a level lying above the bottom plate 1*a*. A separating drum 4 is supported for rotation by an output shaft of a counting electric motor, not shown, and adapted for separately extracting these banknotes 2. The drum 4 is disposed partially within a recess 1*b* formed in the bottom portion 1*a*.

An inclined transport plate 5 providing a transfer passageway is provided below the stack plate 1. On the top of the transport plate 5, and adjacent to the stack plate 1, there is disposed a banknote sensing and discriminating unit 6 which is known per se and adapted for sensing the lengths of the long and short sides, pattern, magnetism or folded edges of the banknotes and discriminating the banknotes of different nominal values.

The sensing and discriminating unit 6 is comprised of electromagnetic means and has a signal generating electromagnetic means and has a signal generating section 6*a* and a signal receiving section 6*b* disposed in opposition to each other and on both sides of the transport plate 5. About centrally of the transport plate 5, there are provided an L-shaped note transfer security member 7 and a reject note stacker 8, said member 7 being carried for rotation by a main body of a half-wrapping device, not shown. On the side of the transport plate 5 opposite to the reject note stacker 8, a changeover shutter plate 9 is rotatably mounted on the main body of the half-wrapping device, not shown. The shutter plate 9 is connected to a driving unit, such as solenoid, which is known per se and therefore not shown, and which is adapted for turning bidirectionally as shown by the solid and dotted lines in FIG. 1 for changing the transport direction of the banknotes. Thus the driving unit is controlled by output signals from the discriminating unit 6 in such a manner that, when the shutter plate 9 is turned to the dotted-line position and projected through an opening 5*a* in the transport plate 5 towards the reject note stacker 8, the notes 2 are supplied into the stacker 8 and there placed, and that, when the shutter plate 9 is turned to the solid-line position, the notes 2 are transferred downward directly.

At the lower part of the transport plate 5 and adjacent to the stacker 8, there is provided a stack unit 10 comprised of a stack plate 11 and a receiving plate 12. An L-shaped edge alignment plate 13 is provided adjacent to one sides of the stack plate 11 and the receiving plate 12. The receiving plate 12 is carried for rotation by the main body, not shown, of the half-wrapping device and turned clockwise in FIG. 1 as the notes are stacked on the stack plates 11.

Figure 2:
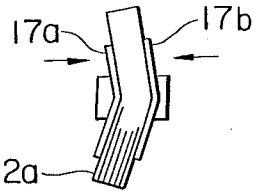
FIG. 2 is a schematic view showing the transport chuck of the apparatus shown in FIG. 1 in the banknote chucking state.

A transfer chuck 17 attached to the foremost part of a slider 16 movable in the direction of the arrow mark A is operably mounted in alignment with the stack unit 10. The chuck 17 consists of a pair of chuck elements 17*a*, 17*b* (FIG. 2) that may be opened apart or closed, one 17*a* of the chuck having a convex chuck surface and the other 17*b* having a concave chuck surface complementary to the mating chuck surface of the element 17*a*.

The slider 16 is movable on a slide guide 18 with a longitudinal concave profile and has its lower surface formed as one with a tooth rack 19 meshing with a gear 24 of a braking unit 23, said gear meshing in turn with a pinion 22 of a rotary shaft 21 of a transport electric motor 20 which is mounted on a frame member. The slider 16 may be reciprocated in the direction of the arrow mark A by the operation of the tooth rack 19.

A half-wrapper ring 25 of the known construction is mounted for encircling the foremost part of the movable member 16, and a stationary plate 27 having a gripping solenoid 26 is mounted to the rear of the movable member 16. An actuating rod 28 for solenoid 26 is connected to the transfer chuck 17 through a connecting rod 28*b*. The numeral 28*a* designates a return spring normally biasing the actuating rod 28 in a direction to open the transfer chuck 17.

The operation of the aforementioned counting and half-wrapping device adapted for discriminating the paper note of different nominal values, is presently described.

A large number of banknotes 2 of different nominal values are stacked on the stack plate 1 and separately extracted in a known manner by the drum 4 which is driven in rotation by the counting electric motor, not shown. The notes 2 are then supplied to the discriminating unit 6 for discriminating of the nominal values and so forth of the notes 2.

In instances where a note 2 is found at the unit 6 to be folded at the corner or to be of other than the desired nominal value, the shutter plate 9 is turned to the double-dotted chain line position in such a manner that the note is supplied to and placed in the reject note stacker 8. On the contrary, in instances where a note is found to be of the desired nominal value, the shutter plate 9 is turned to the other or solid-line position, in such a manner that the desired notes are caused to descend into a space between the opened chuck elements 17*a*, 17*b* and placed on the stack plate 11 of the stack unit 10.

When it is sensed by a counter, not shown, connected to the discriminating unit 6, that 100 (one hundred) notes of the desired nominal value, for example, are supplied into the stack unit 10, the transport motor 20 is driven in reverse for slightly shifting the movable member 16 towards the stacker, so that the banknotes 2 are aligned edgewise by the alignment plate 13. When the grip solenoid 26 is energized in this state, the connecting rod 28*b* is moved along the slider 16 a distance necessary for chucking. The chuck elements 17*a*, 17*b* of the transfer chuck 17 are closed in the direction shown by the arrow mark B for chucking the one end or the half-wrapper side end of a bundle 2*a* of banknotes. At the same time that the bundle 2*a* is moved from the stack unit 10 towards the half-wrapping unit 14, the banknotes 2 of the next stack are introduced into the discriminating unit 6 for commencing the counting operation.

With the notes 2 thus chucked by the transfer chuck 17, the transport electric motor 20 is driven forward, in such a manner that the movable member 16 formed with the toothed rack 19 is displaced towards left in FIG. 1, along a straight path until the bundle 2*a* is pulled towards the leftward position as indicated by double-dotted chain line, that is, a position within a half-wrapper ring 25. During this time, the bundle 2*a* is kept in the chucked state. The slider 16 is then halted in a preset position by the operation of the braking unit 23, at the same time that a sealing tape 25*a* is applied in a known manner by the half-wrapper ring 25 on the periphery of the bundle 2*a* to complete the half-wrapping operation.

Figure 5:
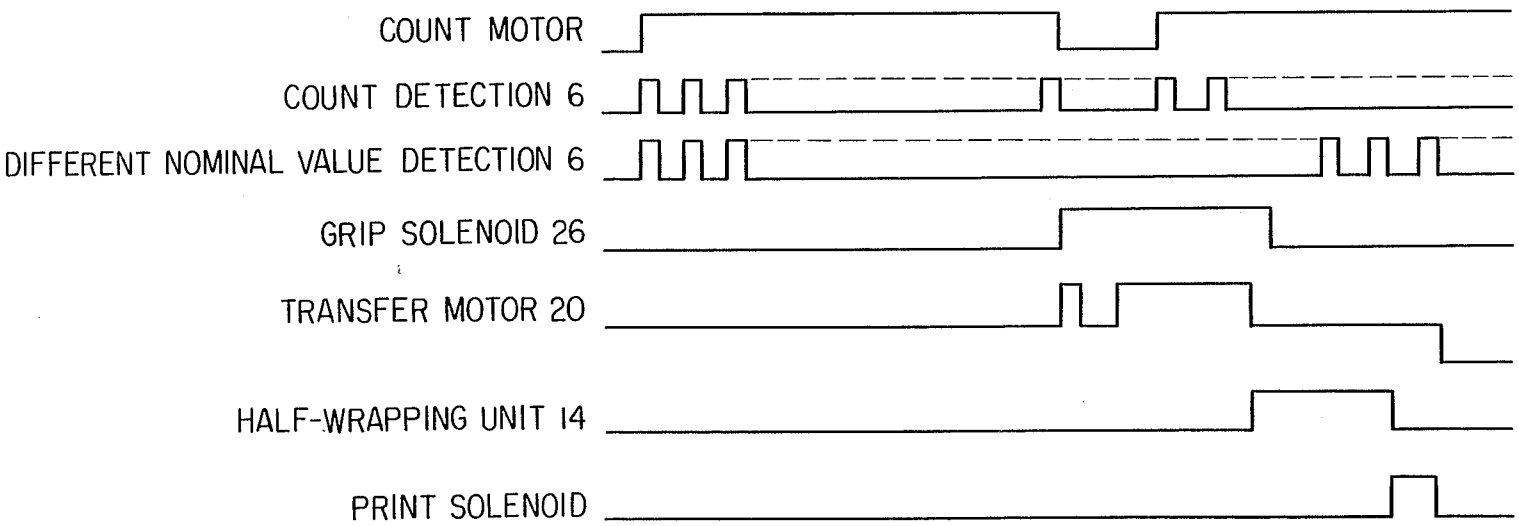
FIG. 5 is a timing diagram showing the operational timing for the sequence of operations carried out in the sequence of operations carried out in the counting and half-wrapping apparatus.

On completion of half-wrapping a printing solenoid, not shown, is energized for applying a stamp seal on the bundle 2*a*. The transport electric motor 20 is then actuated in reverse for shifting the bundle 2*a* out of the half-wrapping unit. Thus the bundle 2*a* is introduced into a bundle stacker, not shown, as it is guided by a supporting plate 10*a*. The transfer chuck is moved further and reaches a position to grip a new bundle of paper sheets, at which time the operation of the transfer electric motor ceases. FIG. 5 shows the operational timing of various operating parts in the course of the aforementioned sequence of operations.

Figure 3:
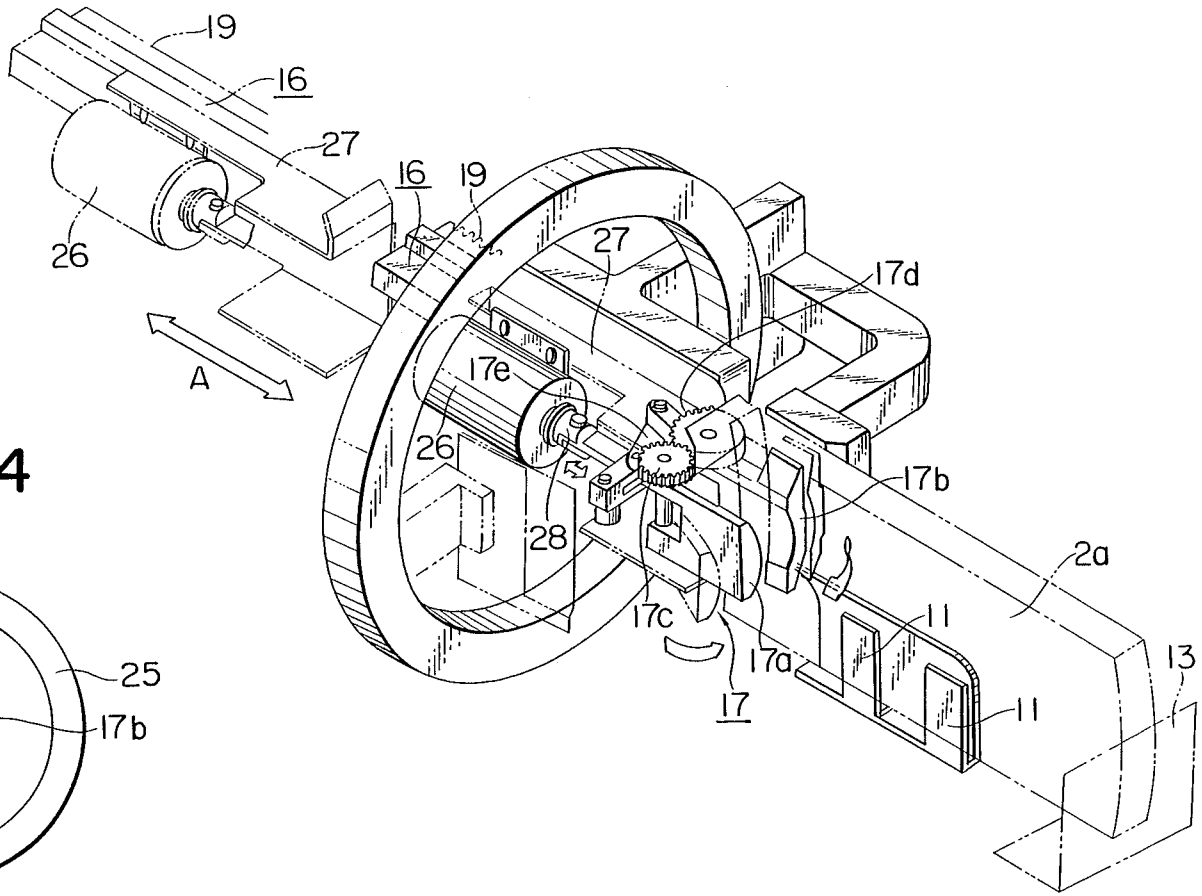
FIG. 3 is a schematic perspective view showing a modified embodiment of the half-wrapping unit of the apparatus shown in FIG. 1.

FIG. 3 shows a modified embodiment of the half-wrapping unit of the counting and half-wrapping apparatus adapted for discriminating the banknotes of different nominal value of the present invention. In this modification, a tooth rack 19 is provided to the lateral side of the movable member 16, and an actuating rod 28 for a grip solenoid 26 provided on a stationary plate 27 of the movable member 16 is coupled to an actuating lever 17*e* in turn associated with meshing gears 17*c*, 17*d* that are provided on chuck elements 17*a*, 17*b*. The bundle 2*a* may be chucked similarly to the preceding embodiment by the operation of the solenoid 26. In FIG. 3, when the movable member 16 is at the solid-line position, the transfer chuck 17 is in the state of chucking or in the state ready to chuck the loose bundle at the stack unit 10. When the member 16 is in the double-chain-dotted line position, the chuck 17 is in the stage of chucking the bundle 2*a* at the half-wrapping unit.

Figure 4:
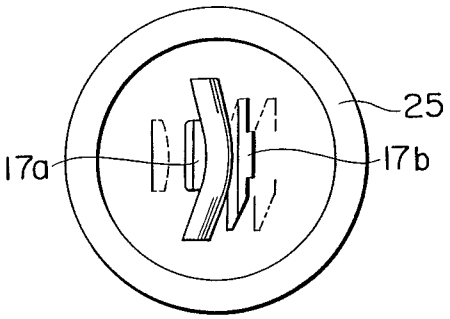
FIG. 4 is a schematic view showing the transport chuck of the apparatus shown in FIG. 3 in the banknote chucking state.

FIG. 4 shows the state in which the bundle 2*a* is chucked by the chuck elements 17*a*, 17*b* in FIG. 3, wherein it is shown that the bundle 2*a* is chucked securely in the bent state.

From the foregoing it is seen that the present invention provides a counting and half-wrapping apparatus adapted to be capable of discriminating the banknotes of different nominal values and by which the presence of a banknote of a different nominal value from one presently processed or a banknote with folded edges or corners may be sensed or discriminated at the sensing and discriminating unit, in such a manner that only the desired banknotes, that is, the banknotes having the desired nominal value and appearance are supplied by the shutter plate towards the stacker, while the reject notes are forwarded by the shutter plate into the reject stacker to permit only the desired banknotes to be half-wrapped by the fully automatic process.

In this manner, the risk that the banknotes of different nominal value from the desired one or banknotes with folded corners or edges be inadvertently half-wrapped with the banknotes of desired nominal value and appearance as is frequently met in the conventional apparatus may be eliminated completely. In addition, the total time interval from the start of counting until the end of half-wrapping may be shortened because the counting for the next batch of paper sheets can be started as soon as a bundle of paper sheets clears the stack unit.

What is claimed is:

1. An apparatus for counting the number of and half-wrapping banknotes, said apparatus being adapted to be capable of discriminating the banknotes of different nominal values, and said apparatus comprising, in combination, a hopper for accommodating a stack of banknotes, a drum mounted at said hopper and adapted for separately extracting said banknotes from said hopper, a substantially vertical transport plate disposed below said drum for receiving and guiding said extracted banknotes in downward direction, a sensing and discriminating unit adjacent to said transport plate below said drum and adapted for sensing or discriminating the nominal value, authenticity or transport state of the banknotes extracted and forwarded by said drum, a changeover shutter plate adjacent to and below said sensing and discriminating unit and adapted for selectively forwarding the banknotes from said sensing and discriminating unit in a selected one of two preset directions, said shutter plate being controlled by output signals supplied from said sensing and discriminating unit, a reject note stacker disposed laterally adjacent to said shutter plate and adapted for receiving rejected banknotes forwarded in one of said selected forwarding directions of said shutter plate, a stack unit adjacent to and below said reject note stacker and adapted for receiving a predetermined number of the desired banknotes forwarded in the other of said selected forwarding directions of said shutter plate, whereby undesired notes contained in the banknotes extracted by said drum are forwarded to said reject note stacker and only the desired notes are forwarded into said stack unit by the operation of said changeover shutter plate, lateral transfer chuck means mounted for movement in a direction transverse to said other of said forwarding directions and toward and away from said stack unit and having means for gripping desired notes in said stack unit and removing the desired notes from said stack unit, and means for moving said chuck means in a direction transverse to said other of said forwarding directions and toward and away from said stack unit.

2. The apparatus as claimed in claim 1, which further comprises means defining a horizontally disposed aperture through said transport plate, said changeover shutter plate being mounted for substantially reciprocal movement between positions respectively extending through and out of said aperture to guide said sensed and discriminated banknotes in the respective of said two preset directions, said reject note stacker comprising a substantially horizontal tray disposed adjacent to said transport plate aperture and spaced laterally away from said transport plate whereby, when said shutter plate is positioned extending through said aperture said rejected banknotes are guided in said one preset direction and, when said shutter plate is positioned out of said aperture said desired banknotes are guided in said other preset direction within said spacing between said reject note stacker and said transport plate.

3. The apparatus according to claim 2, wherein said changeover shutter plate is substantially L-shaped to provide a horizontal portion disposed to extend through and out of said transport plate aperture from the side of said transport plate which is opposite from that of said reject note stacker tray, and a vertical portion mounted for pivotal movement about its upper end.

4. The apparatus as claimed in claim 2, wherein said reject note stacker further comprises a substantially L-shaped note transfer security member providing a substantially horizontal plate portion disposed adjacent to and above said reject note stacker tray for guiding and securing said reject banknotes therebetween, and a substantially vertical hinge plate portion mounted for pivotal movement about its upper end.

* * * * *